US008388199B2

(12) United States Patent
Cheng et al.

(10) Patent No.: US 8,388,199 B2
(45) Date of Patent: Mar. 5, 2013

(54) ADJUSTABLE LAMP DEVICE AND HOLDING MECHANISM THEREOF

(75) Inventors: Gang Cheng, Shenzhen (CN); Rui Liu, Shenzhen (CN); Meng-Hua He, Shenzhen (CN); Te-Sheng Jan, Taipei Hsien (TW); Yu-Tao Chen, Taipei Hsien (TW); Chun-Che Yen, Taipei Hsien (TW); Wen-Hsiang Lu, Taipei Hsien (TW); Ting Dong, Shenzhen (CN)

(73) Assignees: Hong Fu Jin Precision Industry (ShenZhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 263 days.

(21) Appl. No.: 12/829,573

(22) Filed: Jul. 2, 2010

(65) Prior Publication Data

US 2011/0194286 A1 Aug. 11, 2011

(30) Foreign Application Priority Data

Feb. 5, 2010 (CN) ..... 2010 1 0301301

(51) Int. Cl.
*F21V 19/02* (2006.01)

(52) U.S. Cl. ..... 362/418; 362/253; 362/382; 362/410; 362/432

(58) Field of Classification Search ..... 362/253, 362/382, 410, 418, 431, 432
See application file for complete search history.

(56) References Cited

U.S. PATENT DOCUMENTS

2004/0095766 A1* 5/2004 Chan ..... 362/285

FOREIGN PATENT DOCUMENTS

| | | | |
|---|---|---|---|
| CH | 115573 | A | 7/1926 |
| CN | 2588193 | A | 11/2003 |
| CN | 101614236 | A | 12/2009 |
| GB | BG2110333 | A | 6/1983 |
| JP | 2767683 | B2 | 6/1998 |
| TW | 265827 | | 12/1995 |

* cited by examiner

*Primary Examiner* — Meghan Dunwiddie
(74) *Attorney, Agent, or Firm* — Altis Law Group, Inc.

(57) ABSTRACT

A lamp device includes a lamp seat defining a first through hole, a lamp main body defining a second through hole, and a holding mechanism. The holding mechanism includes a bolt, a first nut, and a second nut. The bolt includes a head and a spindle connecting to the head. The spindle defines first screw threads at the opposite end from the head and second screw threads adjacent to the first screw threads. The threads per inch of the first screw threads are smaller than that of the second screw threads. The spindle passes though the first through hole and the second through hole to connect with the lamp main body and the lamp seat. The first nut and the second nut are respectively fit over the first screw threads and the second screw threads.

5 Claims, 5 Drawing Sheets

ADJUSTABLE LAMP DEVICE AND HOLDING MECHANISM THEREOF

BACKGROUND

1. Technical Field

The present disclosure relates to lamp devices and, especially to an adjustable lamp device and a holding mechanism thereof.

2. Description of Related Art

Lamp devices generally have a lamp seat, a lamp shade with light sources being mounted therein and a rotatable hinge. The adjustable hinge connects the lamp seat to the lamp shade, and adjustments have to be made to the light source at various heights. But after long time use, the adjustable hinge will weaken due to the wear and tear happened caused by the friction between the adjustable hinge and the lamp seat.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
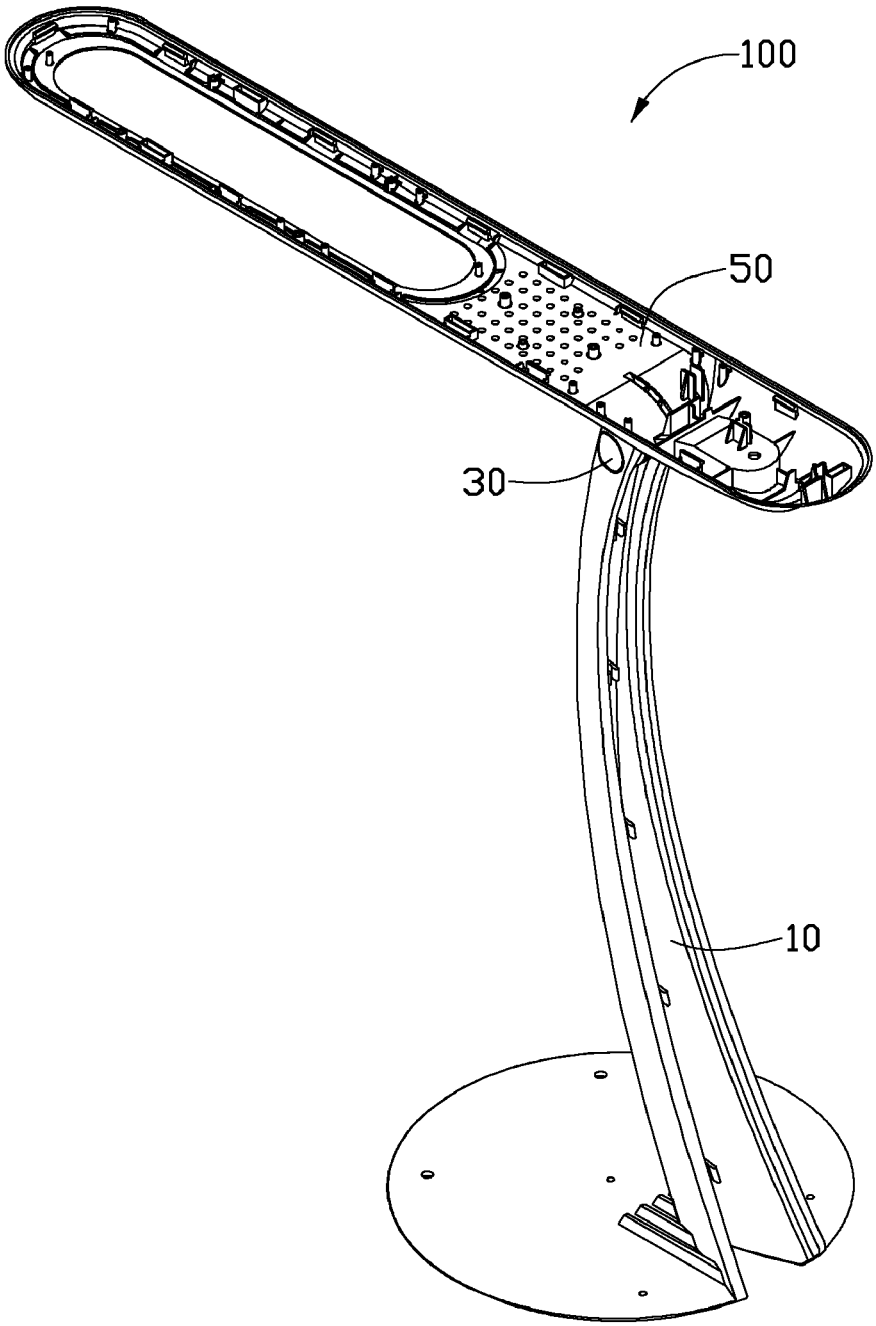
FIG. 1 is an isometric view of an adjustable lamp device, according to an exemplary embodiment.
Figure 2:
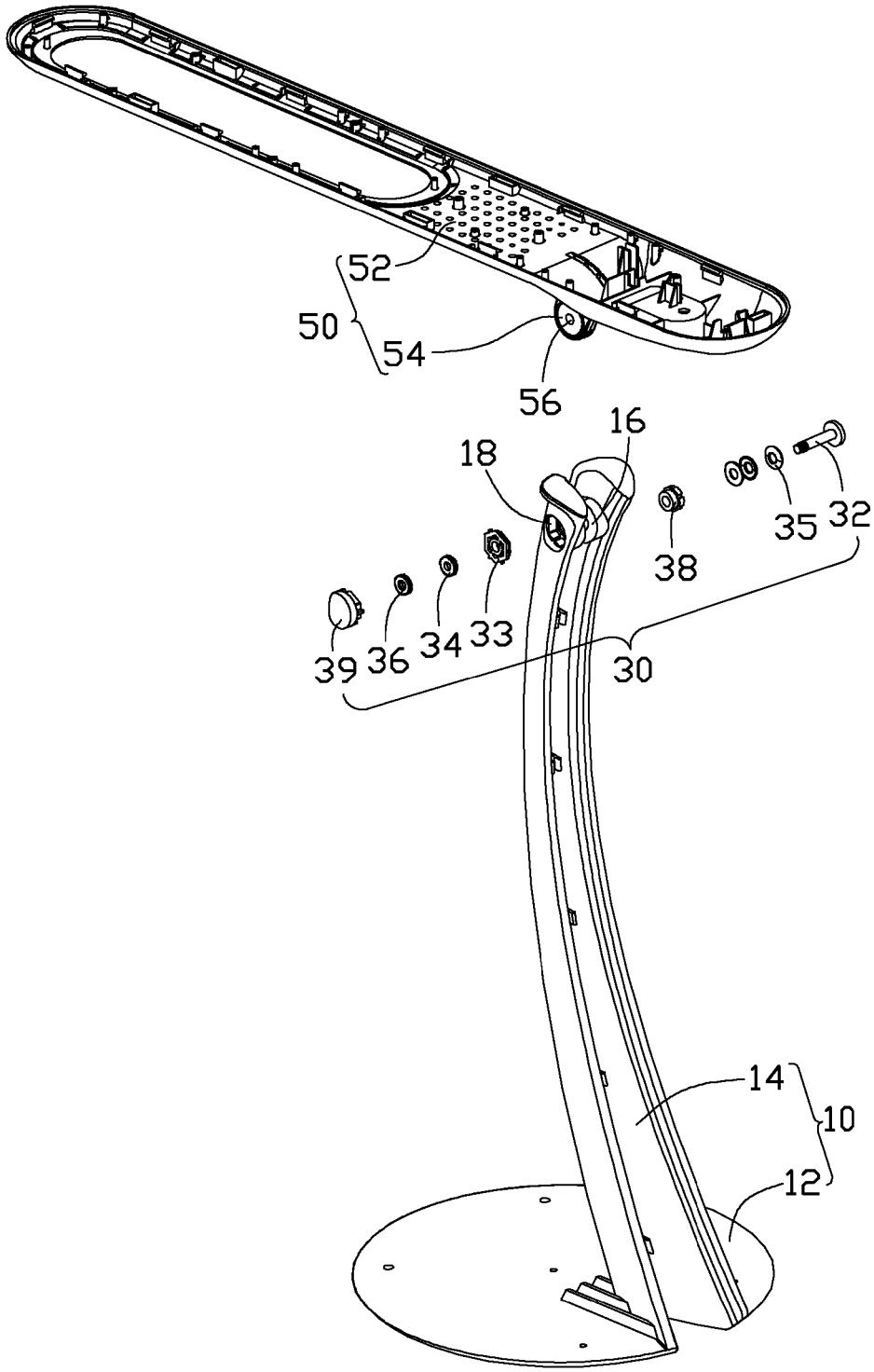
FIG. 2 is an exploded, isometric view of the adjustable lamp device in FIG. 1.

Referring to FIGS. 1 and 2, an adjustable lamp device 100 includes a lamp seat 10, a lamp main body 50 and a holding mechanism 30. The lamp seat 10 includes a base 12 and a neck 14, the neck 14 extending up from the base 12. The neck 14 defines a recess 16 and a first through hole 18 communicated with the recess 16. The lamp main body 50 includes a lamp shade 52 and a cylindrical connecting member 54 extending from the lamp shade 52 toward the neck 14. The connecting member 54 contains a second through hole 56. The connecting member 54 is received in the recess 16 and the second through hole 56 is aligned with the first through hole 18.

The holding mechanism 30 includes a bolt 32, washers 35, a first friction member 38, a second friction member 33, a first nut 34, a second nut 36 and a cover member 39.

Figure 3:
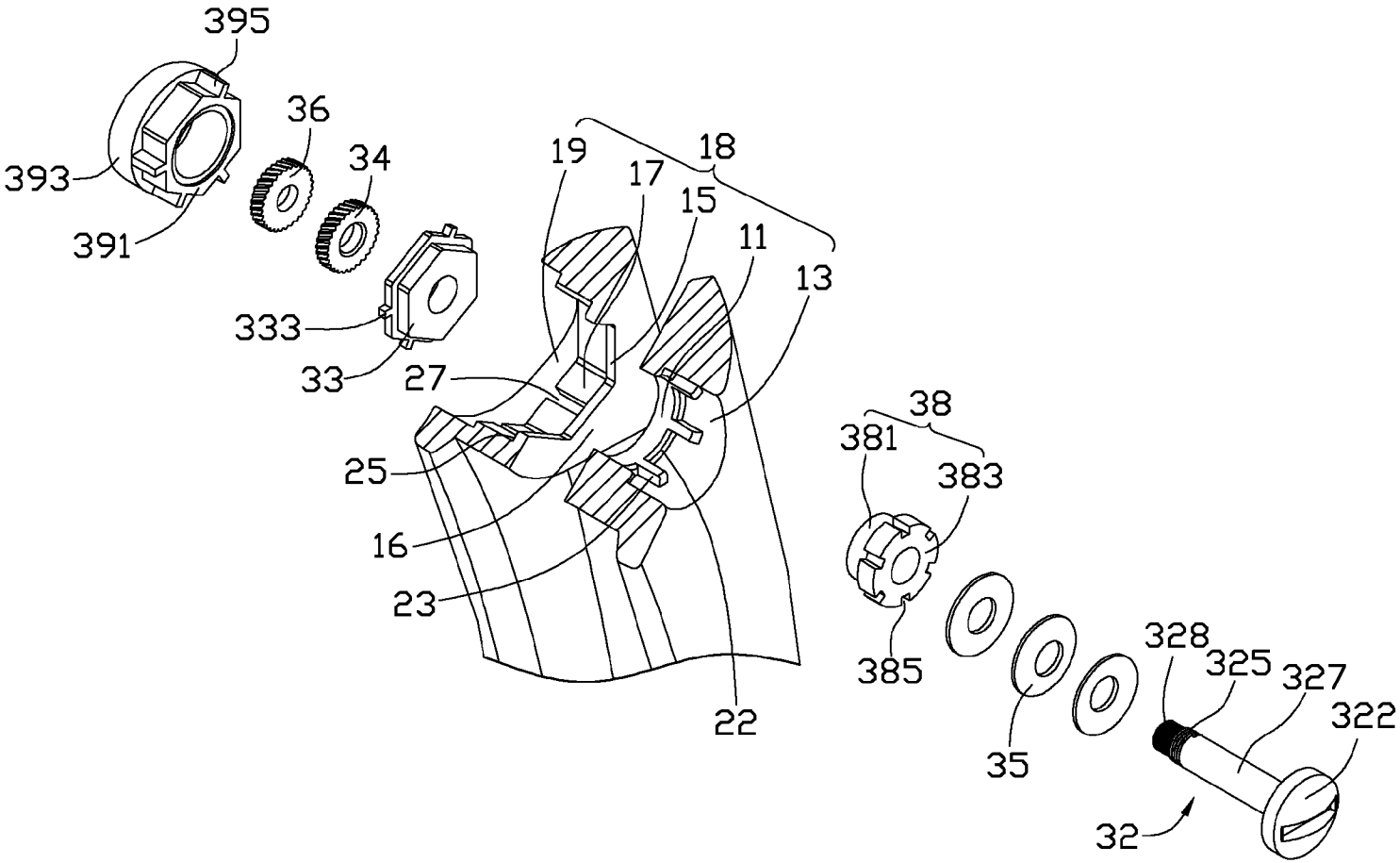
FIG. 3 is a partial, enlarged view of the adjustable lamp device in FIG. 2.
Figure 4:
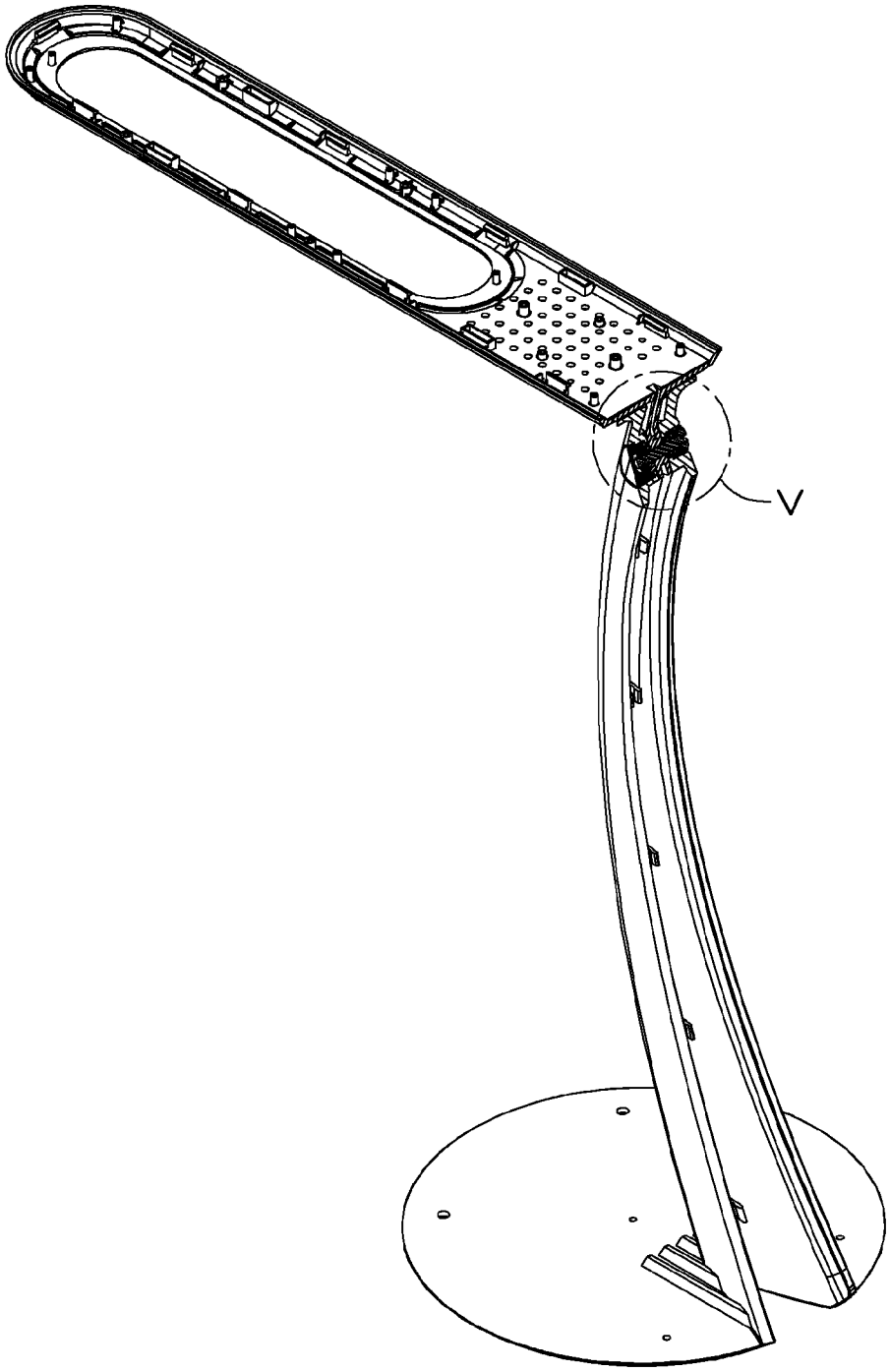
FIG. 4 is similar to FIG. 1, illustrating the location of the cut-away section V.
Figure 5:
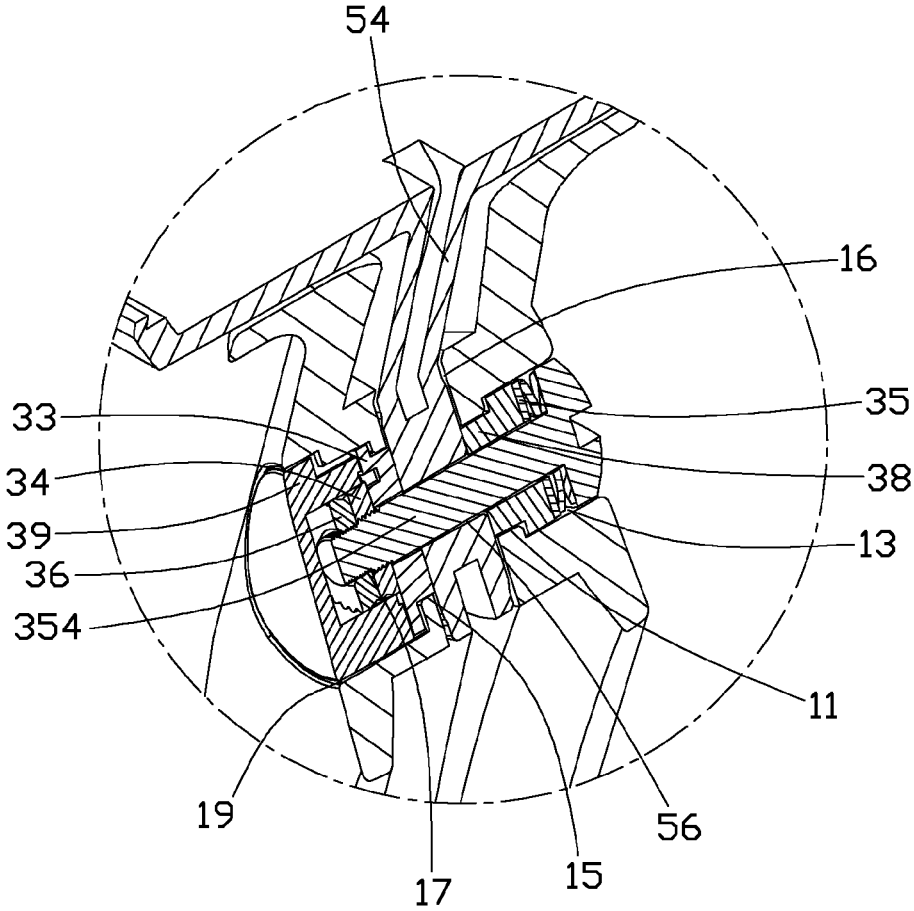
FIG. 5 is an enlarged view of the cut away section V of the adjustable lamp device in FIG. 4.

Referring to FIG. 3, the first though hole 18 includes a first hole 11, a second hole 13 on one side of the recess 16 and a third hole 15, a forth hole 17, a fifth hole 19 on the other side of the recess 16. The first hole 11 is adjacent to the recess 16. The diameter of the first hole 11 is smaller than the second hole 13, to form a first step 22. Shanks 23 protrude from the first step 22 along the axial direction. The third hole 15 is adjacent to the recess 16. The fifth hole 19 is on the outside of the neck 14. The diameter of the holes 15, 17 and 19 increase gradually. Grooves 25, 27 are defined on the inner surface of the hole 15, 17 along the axial direction.

The bolt 32 includes a head 322 and a spindle 327. The spindle 327 includes a pilot or first screw threads 328 at the opposite side from the head 322 and second screw threads 325 adjacent to the first screw threads 328. The second screw thread 325 is between the pilot or first screw thread 328 and the head 322. The diameter of the first screw thread 328 is smaller than that of the second screw thread 325, forming a second step (not marked). The threads per inch of the first screw thread 328 is smaller than that of the second screw thread 325.

The washers 35, the first friction member 38 and the second friction member 33 fit over the spindle 327 passing though the washers 35, and first friction member 38. The washers 35 are received in the second hole 13. The first friction member 38 includes a sleeve 381 and a salient 383 protruding from the sleeve 381. The sleeve 381 is received in the first hole 11. The salient 383 defines slots 385 along the axial direction of the sleeve 381. The shanks 23 are inserted into the slots 385, to prevent the first friction member 38 from rotating in the first hole 11. The spindle 327 continues through to the second through hole 56 of the cylindrical connecting member 54, the third hole 15, where the second friction member 33 is received in the third hole 15. The second friction member 33 includes protruded first claws 333 along the radial direction thereof. The first claws 333 are inserted into the grooves 25 to prevent the second friction member 33 from rotating in the third hole 15. The first friction member 38 and the second friction member 33 are respectively positioned on the two sides of the connecting member 54.

The first nut 34 and the second nut 36 fit over the pilot or first screw thread 328 and the second screw thread 325 respectively. The first nut 34 clings with the second friction member 33 which is received in the fourth hole 17 making the first friction member 38 and the second friction member 33 respectively compress against the two sides of the connecting member 54, and prevent the connecting member 54 from moving. When a user adjusts the lamp main body 50, if the bolt 32 rotates with the connecting member 54, because the threads per inch of the second screw thread 325 is higher than that of the first screw thread 328, the second nut 36 will prevent the first nut 34 from rotating and moving to the second nut 36, thus preventing loosening of the first nut 34 when the lamp main body 50 is adjusted.

The cover member 39 is made of elastic material, including an accommodating portion 391 and a cover 393. The accommodating portion 391 includes protruded second claws 395. The cover 393 is situated in the fourth hole 19, and the second claws 39 are inserted into the grooves 27. The size of the cover 393 is bigger than that of the hole 19. As the cover 393 is elastic, the cover 393 can insert into the hole 19 to cover the hole 19.

It is to be understood, however, that even though numerous characteristics and advantages of the present disclosure have been set forth in the foregoing description, together with details of the structure and function of the present disclosure, the present disclosure is illustrative only, and changes may be made in detail, especially in matters of shape, size, and arrangement of parts within the principles of the present disclosure to the full extent indicated by the broad general meaning of the terms in which the appended claims are expressed.

What is claimed is:

1. A lamp device comprising:

a lamp seat defining a first through hole;

a lamp main body defining a second through hole;

a holding mechanism comprising:

a bolt comprising a head and a spindle, wherein the spindle defines first screw threads at an opposite side from the head and second screw threads adjacent to the first screw threads, the diameter and the threads per inch of the first screw threads are respectively smaller than those of the second screw threads, the spindle passes though the first through hole and the second through hole to connect the lamp main body with the lamp seat;

a first nut fit over the first screw threads; and a second nut fit over the second screw threads.

2. The lamp device of claim 1, wherein the lamp seat includes a base and a neck extending from the base, the neck defines a recess communicating with first through hole, the lamp main body includes a lamp shade and a cylindrical connecting member extending from the lamp shade toward the neck, the connecting member is received in the recess, the second through hole is defined on the connecting member.

3. The lamp device of claim 2, further comprising a friction member defining slots, wherein the first though hole includes two holes which are both positioned on one side of the recess, the two holes have different diameters and form a step, shanks protrude from the step along the axial direction and are received in the slots.

4. The lamp device of claim 2, further comprising a friction member comprising protruded claws, wherein the first though hole includes a hole which is positioned on one side of the recess, grooves are defined on the inner surface of the hole along the axial direction, the claws are received in the grooves.

5. A holding mechanism configured for fixing a connecting member, the holding mechanism comprising:

a bolt comprising a head and a spindle, wherein the spindle defines first screw threads at the opposite side from the head and second screw threads adjacent to the first screw threads, the spindle passes though the connecting member, the diameter and threads per inch of the first screw threads are respectively smaller than those of the second screw threads;

a first nut fit over the first screw threads; and a second nut fit over the second screw threads.

* * * * *